United States Patent [19]

Ray

[11] 4,246,454

[45] Jan. 20, 1981

[54] TIMING MECHANISM HAVING A SHORT PULSE PRIOR TO ITS OVERALL PROGRAM

[75] Inventor: Donald L. Ray, Oaklandon, Ind.

[73] Assignee: Emhart Industries, Inc., Indianapolis, Ind.

[21] Appl. No.: 967,917

[22] Filed: Dec. 11, 1978

[51] Int. Cl.[3] ..... H01H 7/08

[52] U.S. Cl. ..... 200/38 R; 200/38 A; 200/38 F; 200/38 FA

[58] Field of Search ..... 200/38 R, 39 R, 38 B, 200/38 BA, 38 A; 219/10.55 B

[56] References Cited

U.S. PATENT DOCUMENTS

| | | | |
|---|---|---|---|
| 1,392,160 | 9/1921 | Hipple | 200/17 R |
| 2,939,924 | 6/1960 | Franck | 200/38 A |
| 3,264,879 | 8/1966 | Danek | 74/3.5 |
| 4,001,529 | 1/1977 | Mahon | 200/39 R |

*Primary Examiner*—J. V. Truhe
*Assistant Examiner*—Morris Ginsburg
*Attorney, Agent, or Firm*—Robert F. Meyer; David W. Gomes

[57] ABSTRACT

A cam is axially displaced so that a pair of cam followers sequentially drop from the cam's outer periphery to sequentially close a pair of electrical switches which are responsive to the cam followers. Upon completion of a program, the cam is permitted to displace to its original position. A coil spring clutch permits an actuator to be located in a predetermined position for axial displacement of the cam.

11 Claims, 10 Drawing Figures

TIMING MECHANISM HAVING A SHORT PULSE PRIOR TO ITS OVERALL PROGRAM

BACKGROUND OF THE INVENTION

Generally speaking, the present invention relates to a timing mechanism which comprises a shaft means, locator means carried by the shaft means, first ramp means coupled to the locator means to position the ramp means in a predetermined position, clutch means coupled to the locator means and the first ramp means, cam means slideably carried on the shaft means and coupling means coupling same to the cam means for rotation therewith, spring means axially biasing the cam means, second ramp means coupled to the cam means and engaging the first ramp means to selectively axially displace the cam means in a predetermined direction, first and second cam followers engaging the cam means to be actuated in accordance with an axial displacement of the cam means, switch means opening and closing in response to movement of the cam followers, and release means permitting the cam means to axially return past the cam followers to its original position.

The invention pertains to a timing mechanism, and more particularly to a timing mechanism wherein there are means for providing a pulse of very short duration prior to an overall program of the timing mechanism.

Timing mechanisms are extensively used in the appliance industry to control the functions of an appliance in accordance with a predetermined program. For example, they are extensively used in washers, dryers, dishwashers, and microwave ovens. In some of these applications the need arises for a short pulsing cycle to be operable within or separate from an overall program. In microwave ovens, for example, such a short pulse is sometimes needed to intermittently apply electrical power to its magnetron. When such power is initially applied to the magnetron, a very high current surge is imposed on the circuit. The surge then drops off. Therefore, there is also a need in this application to provide an even shorter pulse whereby current can be initially switched through a current limiting resistor. The present invention provides a means for achieving short pulses in a very simple and economical manner.

OBJECTS OR FEATURES OF THE INVENTION

It is, therefore, a feature of the invention to provide a timing mechanism having a means to provide short pulsing cycles in addition to an overall program. Another feature of the invention is the provision of such a timing mechanism wherein the short pulses are initiated by a pair of cam followers sequentially dropping from a cam periphery. Still another feature of the invention is the provision of such a timing mechanism wherein the cam followers sequentially drop from the cam's periphery in response to an axial displacement of the cam. Another feature of the invention is the provision of such a timing mechanism wherein the axial displacement of the cam is provided by a first ramp carried by the cam engaging a second ramp to be actuated thereby. Yet another feature of the invention is the provision of such a timing mechanism wherein there is a means to locate the second ramp in a predetermined position so as to initiate and terminate the short pulse according to a predetermined time period. Another feature of the invention is to provide such a timing mechanism wherein there is a clutch means permitting manual setting of a locator means for the second ramp. Another feature of the invention is the provision of such a timing mechanism wherein there is a release means permitting the cam to be axially displaced and return past the cam followers to its original position upon completion of the program. These and other features of the invention will become apparent from the following description taken in conjunction with the accompanying drawings.

DETAILED DESCRIPTION OF THE INVENTION

Figure 1:
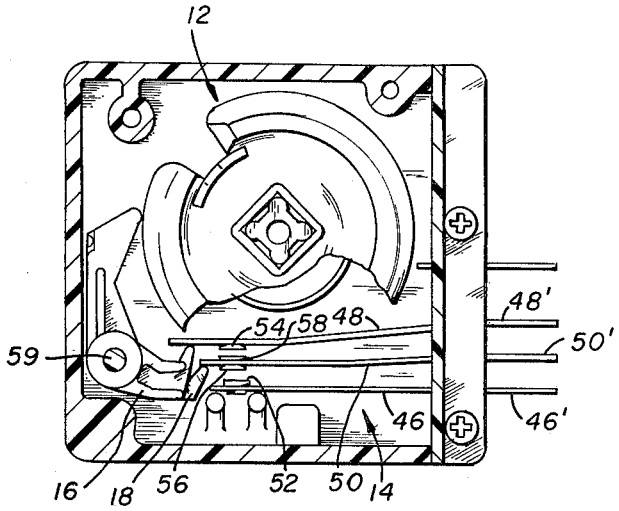
FIG. 1 is a section of the timing mechanism employing the principles of the invention.

Referring to the drawings, there is shown a timing mechanism 10 employing the features of the invention. In general timing mechanism 10 includes a cam means 12, switch means 14 responsive thereto through cam followers 16 and 18, and a motor drive means 20 which applies power driven rotation to the cam means. The motor drive means includes a synchronous motor and a gear train, both of which are well known in the art and therefore not shown.

Cam means 12 includes a cam 24 having a step 26 in its outer periphery, and a ramp means 28 extending from a face of the cam at the step. The cam is coupled to the gear train of the motor for rotation therewith through coupling means 30. Coupling means 30 also permits the cam to axially displaced and includes a square aperture 32 provided in the cam and a basically square shaft 34 which mates the aperture. Shaft 34 serves as the output pinion of the gear train of the motor. Its opposed end is journalled for rotation about an end of shaft 36 (end not shown). As will be hereinafter described, cam 24 rotates with shaft 34 and is axially displaceable thereon. The cam is axially spring biased through coil spring 40 which is held between the cam 24 and disk 42 which is held against plate 43 carried by housing 44 of the timing mechanism. Ramp means 28 includes a V-shaped tab 38, to provide two ramp surfaces.

Switch means 14 (FIG. 1) includes contact blades 46, 48, and 50 each integral or otherwise coupled to electrical terminals 46', 48' and 50'. Contact blade 46 carries an electrical contact 52 at a distal end thereof, contact blade 48 carries an electrical contact 54 carried at its distal end, while contact blade 50 carries a pair of electrical contacts 56 and 58 at its distal end in line with the other electrical contacts. The switch means are open and closed in accordance with cam followers 16 and 18 in a manner hereinafter to be described. Cam followers 16 and 18 are pivotally carried on a post 59 to be actuated in accordance with cam 24.

Figure 2:
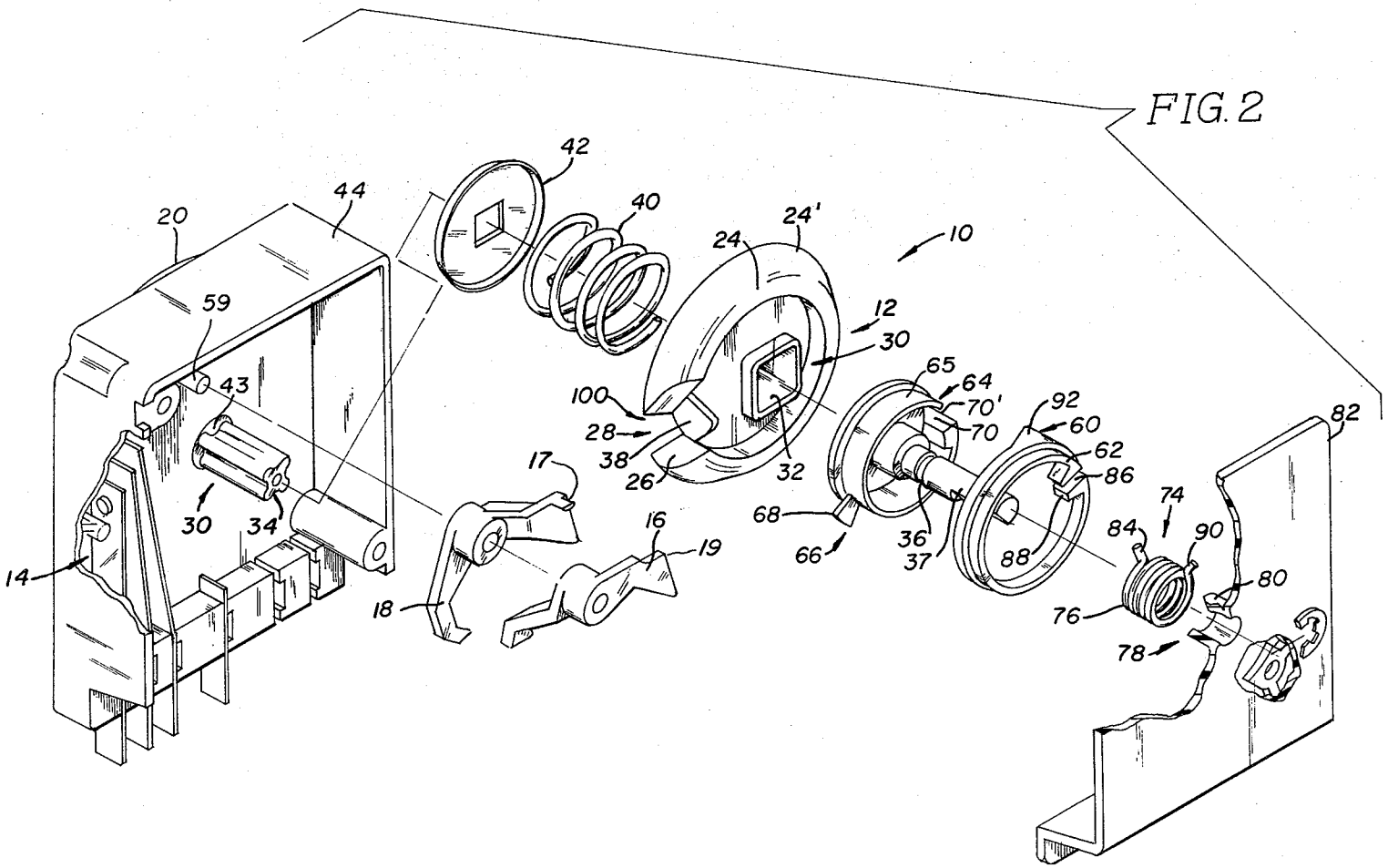
FIG. 2 is an exploded view of the timing mechanism.

Referring to FIG. 2, cam 24 is axially displaced through its ramp means 28 engaging a second ramp means 60 carried by a ring 62. Ring 62 is coupled to and located by a locator means 64 which is fixedly carried on shaft 36. Locator means 64 includes a disk 65 having a stop means 66 in the form of a tab 68 extending from its periphery and a notch 70 through which ring 62 is coupled. Tab 68 engages a boss 72 (FIG. 3B) carried by housing 44 to limit rotation of the disk. Ring 62 is coupled to disk 65 through clutch means 74. Clutch means 74 includes a coil spring 76 carried on a holding means 78. In the present embodiment holding means 78 includes a boss 80 carried on plate 82 of housing 44. An end 84 of the coil spring engages a slot 86 in tab 88 extending from ring 62. Another end 90 of the coil spring is carried in a space 87 between tab 88 and a wall 70′ of slot 70 when the tab is inserted in the slot (See also FIG. 3B). Clutch means 74 permits the locator means with the ring 62 to be manually rotated in a predetermined direction to locate the ramp means 60 at a predetermined point and at the same time permits ramp means 60 to engage and move cam 24 axially while the ramp means is held in a fixed position. Locator means may be manually rotated in either a clockwise or counterclockwise direction. Ramp means 60 includes a V-shaped tab 92 extending from ring 62 and engaging ramp means 28.

Shaft 36 is manually rotated independently of shaft 34 through a knob (not shown) connected to D-portion 37 of the shaft in a clockwise direction. Locator means 64 and ring 62 rotate together through the coupling of spring 76, the spring rotating about boss 80. Rotation is continued to a predetermined position, the rotation being limited by tab 68 engaging boss 72. During power driven rotation of cam 24 in the opposite direction, ramp means 28 engages ramp means 60, ramp means 60 being held in place by a tightening of the spring on boss 80. As will be more fully described hereinafter with reference to FIGS. 3A through 6B, during power driven rotation of cam 24, cam followers 16 and 18 ride on the outer most periphery 24′ of the cam. When ramp means 28 comes into engagement with ramp means 60, with ramp means 60 being held in place, cam 24 will be axially displaced along shaft 34 to permit cam followers 16 and 18 to sequentially drop and close the contacts of switch means 14. The cam followers will remain in the dropped position until a program cycle is completed at which time a release means 100 permits the cam to be axially displaced past the cam followers to its original position. Release means 100 includes step 26 in cam 24.

Figure 6A:
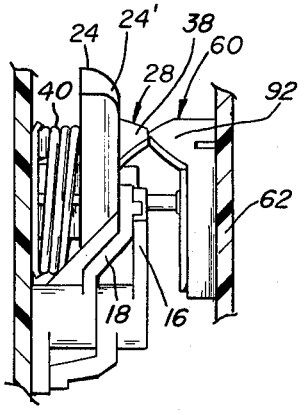
FIGS. 3A through 6B are similar views in partial section showing different operating stages of a cam means of the timing mechanism.
Figure 6B:
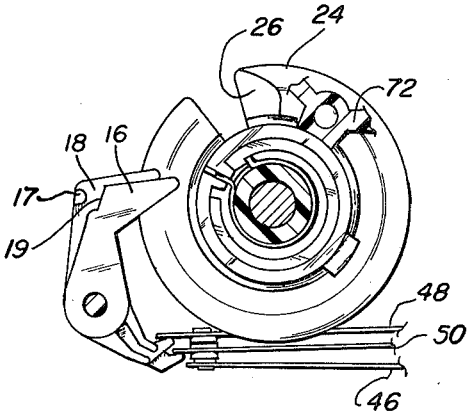
Figure 3A:
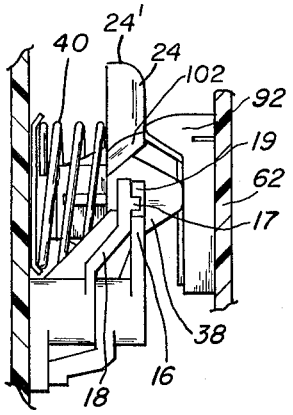
Figure 3B:
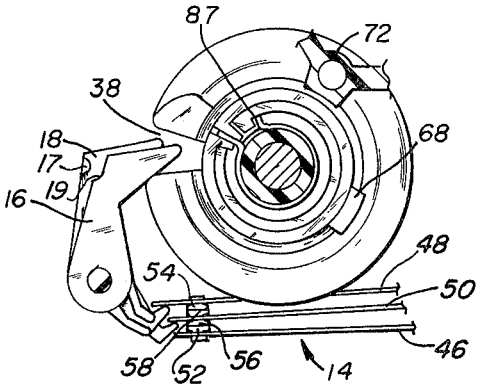
Figure 4A:
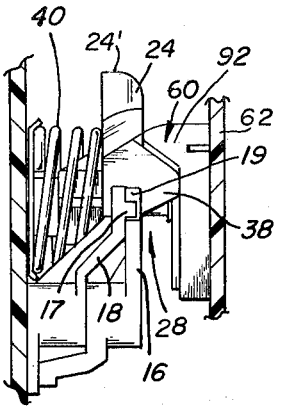
Figure 4B:
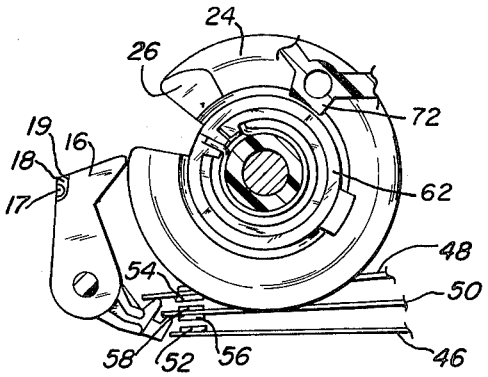
Figure 5A:
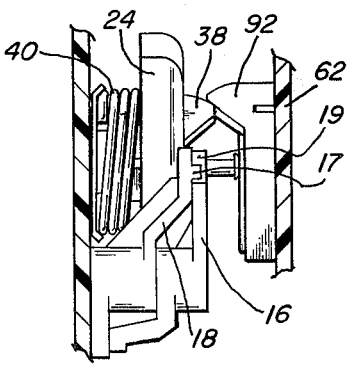
Figure 5B:
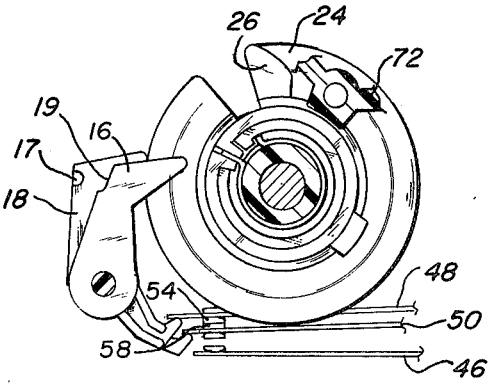

Referring now to FIGS. 3A through 6B the operation of the timing mechanism with particular respect to the switch means 14 acting in response to cam 24 can be described. The sequence of operation described assumes that the ramp means 60 has been manually set. Cam 24 may now be continually power driven as long as desired. In FIGS. 3A and 3B cam 24 has been axially displaced by permitting cam followers 16 and 18 to engage with step 38 to permit the cam to return at the end of a program. Note that coil spring 40 has expanded to cause the displacement of cam 24. As shown in FIG. 3B in this position all of the electrical contacts of switch means 14 are closed. Thus, the switch means is biased to be normally closed. In FIGS. 4A and 4B cam 24 has been rotated an amount sufficient for both cam followers 16 and 18 to disengage step 38 to rise and ride on the outer periphery of the cam 24. As particularly shown in FIG. 4B all of the electrical contacts are now open. The cam followers are made to rise together through the engagement of notch 19 of cam follower 16 engaging tab 17 of cam follower 18. In a microwave oven, the magnetron would be off. Note that ramp means 28 and 60 have not been engaged. In FIGS. 5A and 5B cam 24 has been rotated sufficient to cause an initial engagement of the two ramp means such that cam follower 16 has dropped off of the outer periphery of the cam. In this position electrical contacts 54 and 58 are closed and, in the case of the magnetron, power has been applied to the magnetron through a current limiting resistor to cut back the current surge. In FIGS. 6A and 6B ramp means 60 and 28 are fully engaged at their peak position to further axially displace cam 24 so that both cam followers 16 and 18 have dropped from the cam's outer periphery to close all of the electrical contacts. Power to the magnetron is now applied through another circuit bi-passing the current limiting resistor and remains on until the mode of FIGS. 4A and 4B is reached. The complete cycle lasts about 12 seconds, for example.

What is claimed is:

1. A timing mechanism comprising:
(a) shaft means,
(b) locator means rotatably carried by said shaft means,
(c) first ramp means coupled to said locator means,
(d) clutch means coupled to said locator means and said first ramp means,
(e) a single cam slideably carried on said shaft means and coupling means coupling same to said shaft means for rotation therewith,
(f) spring means axially biasing said single cam
(g) second ramp means coupled to said single cam and engaging said first ramp means to selectively axially displace said single cam in a predetermined direction,
(h) first and second cam followers engaging said single cam to be sequentially actuated in accordance with an axial displacement of said single cam, and switch means opening and closing in response to said cam followers, and
(i) release means permitting said single cam to axially displace past said cam followers to its original position.

2. A timing mechanism according to claim 1 wherein said locator means includes a disk and said first ramp means includes a ring coupled to said disk and having a ramp extending therefrom.

3. A timing mechanism according to claim 2 wherein said first ramp includes a V-shaped tab.

4. A timing mechanism according to claim 2 wherein said ring is coupled to said disk by a tab carried by said ring engaging a slot in said disk.

5. A timing mechanism according to claim 2 wherein said clutch means includes a coil spring, holding means extending through its coil and opposed ends thereof engaging said disk and said ring, respectively.

6. A timing mechanism according to claim 5 wherein said ring is coupled to said disk by a tab carried by said ring and engaging a slot in said disk and wherein one of said opposed ends engages a slot in said tab and the other end engages a second slot in said disk.

7. A timing mechanism according to claim 3 wherein said second ramp means includes a V-shaped tab extending from said single cam.

8. A timing mechanism according to claim 1 wherein said cam followers operate from a common pivot axis and wherein both cam followers engage the outer periphery of said single cam, axial displacement of said single cam causing said cam followers to drop from said outer periphery in sequence.

9. A timing mechanism according to claim 1 wherein said coupling means includes a substantially square aperture in said single cam mating a substantially square portion of said shaft means.

10. A timing mechanism according to claim 1 wherein said release means includes a step in said single, rotation of said single cam causing said step to be aligned with said cam followers,

11. In a timing mechanism wherein at least one pulse cycle is provided prior to another pulse cycle, a single cam rotatably driven on a shaft means, at least two cam followers engaging an outer periphery of said single cam, means axially displacing said single cam along said shaft means whereby said cam followers sequentially drop from said periphery to cause actuation of said cam followers, switch means responsive to said actuatation, and release means permitting said single cam to axially displace and return to its original position past said cam followers.

* * * * *